US006211130B1

(12) United States Patent
Josa Pons et al.

(10) Patent No.: US 6,211,130 B1
(45) Date of Patent: Apr. 3, 2001

(54) USE OF QUATERNARY ACETONITRILE COMPOUNDS AS ACTIVATORS FOR DETERGENTS

(75) Inventors: Jaume Josa Pons, Terassa; Adolf Arranz Catalina, Barcelona, both of (ES)

(73) Assignee: Henkel Kommanditgesellschaft Auf Aktien, Dusseldorf (DE)

( * ) Notice: Subject to any disclaimer, the term of this patent is extended or adjusted under 35 U.S.C. 154(b) by 0 days.

(21) Appl. No.: 09/121,263

(22) Filed: Jul. 23, 1998

Related U.S. Application Data

(60) Provisional application No. 60/056,486, filed on Aug. 21, 1997.

(51) Int. Cl.[7] ..... C11D 1/86; C11D 3/28; C11D 3/39; C11D 3/395

(52) U.S. Cl. ..... 510/314; 510/303; 510/372; 510/376; 510/499; 510/504; 252/186.39

(58) Field of Search ..... 510/303, 314, 510/372, 376, 499, 504; 252/186.39

(56) References Cited

U.S. PATENT DOCUMENTS 5,814,242 * 9/1998 Alvarez et al. ..... 252/186.39
5,888,419 * 3/1999 Casella et al. ..... 252/186.39

OTHER PUBLICATIONS

Progr. Phys. Org. Chem. 11, 1(1974), Abraham No Month Available.

Journal of Am. Chemical Society 102, 5829 (1980), Arnett Mar. 1980.

J. Falbe (ed.), "Surfactants in Consumer Products", Springer Verlag, Berlin, 1987, pp. 55 to 124, No Month Available.

J. Falbe (ed.), "Katalysatoren Tenside und Mineraloeladditive", Thieme Verlag, Stuttgart, 1978, pp. 123–217 No Month Available.

* cited by examiner

*Primary Examiner*—Gregory DelCotto
(74) *Attorney, Agent, or Firm*—Connolly, Bove, Lodge & Hutz LLP

(57) ABSTRACT

The invention relates to the use of quaternary acetonitrile compounds corresponding to formula (I):

(I)

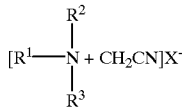

in which $R^1$, $R^2$ and $R^3$ independently of one another represent an alkyl, alkenyl or aryl group containing 1 to 18 carbon atoms and the groups $R^2$ and $R^3$ may also be part of a heterocycle including the N atom and, optionally, other hetero atoms and X is a charge-equalizing anion, for activators for detergents, more particularly detergents containing inorganic peroxygen compounds. The activators may be directly added to liquid detergents or may be added to the wash liquor together with the detergents in the form of aqueous preparations. Without the addition of hydrogen peroxide, a distinct color-lightening effect is obtained, even at low washing temperatures.

2 Claims, No Drawings

USE OF QUATERNARY ACETONITRILE COMPOUNDS AS ACTIVATORS FOR DETERGENTS

CROSS REFERENCE TO RELATED APPLICATIONS

This application claims the benefit of earlier filed and copending provisional application Serial No. 60/056,486, filed on Aug. 21, 1997, the entire contents of which are incorporated herein by reference.

BACKGROUND OF THE INVENTION

This invention relates to the use of quaternary acetonitrile compounds as activators for detergents, more particularly for detergents containing inorganic peroxygen compounds.

DESCRIPTION OF RELATED ART

Inorganic peroxygen compounds, more particularly hydrogen peroxide, and solid peroxygen compounds, which dissolve in water with elimination of hydrogen peroxide, such as sodium perborate and sodium carbonate perhydrate, have long been used as oxidizing agents for disinfection and bleaching purposes. In dilute solutions, the oxidizing effect of these substances depends to a large extent on temperature. For example, with $H_2O_2$ or perborate in alkaline bleaching liquors, sufficiently fast bleaching of soiled textiles is only achieved at temperatures above about 80° C. At lower temperatures, the oxidizing effect of the inorganic peroxygen compounds can be improved by addition of so-called bleach activators, for which numerous proposals are known from the literature, above all from the classes of N- or O-acyl compounds, for example polyacylated alkylene diamines, more particularly tetraacetyl ethylenediamine, acylated glycolurils, more particularly tetraacetyl glycoluril, N-acylated hydantoins, hydrazides, triazoles, hydrotriazines, urazoles, diketopiperazines, sulfuryl amides and cyanurates, and also carboxylic anhydrides, more particularly phthalic anhydride, carboxylic acid esters, more particularly sodium nonanoyloxybenzene sulfonate, sodium isononanoyloxybenzene sulfonate, and acylated sugar derivatives, such as pentaacetyl glucose. The bleaching effect of aqueous peroxide liquors can be increased by addition of these substances to such an extent that substantially the same effects are achieved at temperatures of only around 60° C. as are obtained with the peroxide liquor alone at 95° C.

Within the context of the efforts being made to develop energy-saving washing and bleaching processes, application temperatures well below 60° C. and, more particularly, below 45° C. down to the temperature of cold water, have recently been acquiring increasing significance. At these low temperatures, there is generally a discernible deterioration in the effect of hitherto known activator compounds. Accordingly, there has been no shortage of attempts to develop more effective activators for this temperature range without as yet any evidence of real success.

Accordingly, the problem addressed by the present invention was to provide new activators for the production of detergents which would lead to the improved removal of bleachable soils at low temperatures without damaging the fabric.

DESCRIPTION OF THE INVENTION

The present invention relates to the use of quaternary acetonitrile compounds corresponding to formula (I):

(I)

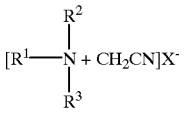

in which $R^1$, $R^2$ and $R^3$ independently of one another represent an alkyl, alkenyl or aryl group containing 1 to 18 carbon atoms and the groups $R^2$ and $R^3$ may also be part of a heterocycle including the N atom and, optionally, other hetero atoms and X is a charge-equalizing anion, as activators for detergents, more particularly for detergents containing inorganic peroxygen compounds.

It has surprisingly been found that the quaternary acetonitrile compounds, preferably N-methyl morpholinium acetonitrile methosulfate, are capable of activating inorganic peroxygen compounds, such as alkali metal perborates or percarbonates, for example, even at low temperatures in the cold-wash range (about 20 to 35° C.), so that these inorganic peroxygen compounds almost completely decolor a number of very different bleachable soils. The activators may be directly added to liquid detergents. In the case of solid detergents, it is advisable to introduce the activators into the wash liquor, for example as aqueous formulations. The invention includes the observation that the effect clearly surpasses that of conventional bleach activators, such as TAED for example, and that the presence of hydrogen peroxide is not necessary and, in many cases, is even undesirable.

Quaternary Acetonitrile Compounds

The quaternary acetonitrile compounds may be produced by, or similarly to, the known processes published, for example, by Abraham in *Progr. Phys. Org. Chem.* 11, 2 (1974) or by Amett in *J. Am. Chem. Soc.* 102, 5829 (1980). It is particularly preferred to use compounds corresponding to formula (1), in which $R^2$ and $R^3$—including the quaternary nitrogen atom—form a morpholinium ring. In these compounds, $R^1$ is preferably an alkyl group containing 1 to 3 carbon atoms, more particularly a methyl group. The anions $X^-$ include, in particular, the halides, such as chloride, fluoride, iodide and bromide, nitrate, hydroxide, hexafluorophosphate, methosulfate and ethosulfate, chlorate, perchlorate, and the anions of carboxylic acids, such as formate, acetate, benzoate or citrate. Compounds corresponding to formula (1), in which $X^-$ is methosulfate, are preferably used.

Detergents

The quaternary acetonitrile compounds may be added to liquid detergents in quantities of 0.1 to 10% by weight, preferably in quantities of 0.5 to 5% by weight and more preferably in quantities of 1 to 3% by weight, based on the detergents. Aqueous preparations of the quaternary acetonitrile compounds may also be prepared and may subsequently be added to the wash liquor as additives together with solid or liquid detergents in such quantities that they are present in a concentration of 0.1 to 10% by weight, based on the detergent.

Besides bleaching agents and surfactants, the detergents may contain other typical ingredients such as, for example, builders, enzymes, enzyme stabilizers, optical brighteners, thickeners, soil repellents, foam inhibitors, solubilizers, inorganic salts and fragrances and dyes.

Among the compounds used as bleaching agents, sodium perborate tetrahydrate and sodium perborate monohydrate are particularly important. Other bleaching agents are, for example, peroxycarbonate, citrate perhydrates and $H_2O_2$-yielding peracidic salts of peracids, such as perbenzoates, peroxyphthalates or diperoxydodecanedioic acid. They are normally used in quantities of 8 to 25% by weight. Sodium perborate monohydrate in quantities of 10 to 20% by weight and, more particularly, 10 to 15% by weight is preferably used. Through its ability to bind free water to form the tetrahydrate, it contributes towards increasing the stability of the detergent.

Suitable surfactants are nonionic, anionic, cationic and/or amphoteric or zwitterionic surfactants which are present in the detergents in quantities of normally abut 50 to 99% by weight and, preferably, 70 to 90% by weight. Typical examples of anionic surfactants are soaps, alkyl benzene sulfonates, alkane sulfonates, olefin sulfonates, alkyl ether sulfonates, glycerol ether sulfonates, X-methyl ester sulfonates, sulfofatty acids, alkyl sulfates, fatty alcohol ether sulfates, glycerol ether sulfates, hydroxy mixed ether sulfates, monoglyceride (ether) sulfates, fatty acid amide (ether) sulfates, monoalkyl and dialkyl sulfosuccinates, monoalkyl and dialkyl sulfosuccinamates, sulfotriglycerides, amide soaps, ether carboxylic acids and salts thereof, fatty acid isethionates, fatty acid sarcosinates, fatty acid taurides, N-acylaminoacids, such as for example acyl lactylates, acyl tartrates, acyl glutamates and acyl aspartates, alkyl oligoglucoside sulfates, protein fatty acid condensates (more particularly wheat-based vegetable products) and alkyl (ether) phosphates. If the anionic surfactants contain polyglycol ether chains, they may have a conventional homolog distribution although they preferably have a narrow homolog distribution. Typical examples of nonionic surfactants are fatty alcohol polyglycol ethers, alkylphenol polyglycol ethers, fatty acid polyglycol esters, fatty acid amide polyglycol ethers, fatty amine polyglycol ethers, alkoxylated triglycerides, mixed ethers and mixed formals, optionally partly oxidized alk(en)yl oligoglycosides and glucuronic acid derivatives, fatty acid-N-alkyl glucamides, protein hydrolyzates (particularly wheat-based vegetable products), polyol fatty acid esters, sugar esters, sorbitan esters, polysorbates and amine oxides. If the nonionic surfactants contain polyglycol ether chains, they may have a conventional homolog distribution although they preferably have a narrow homolog distribution. typical examples of cationic surfactants are quaternary ammonium compounds and esterquats, more particularly quaternized fatty acid trialkanolamine ester salts. Typical examples of amphoteric or zwitterionic surfactants are alkyl betaines, alkyl amidobetaines, aminopropionates, aminoglycinates, imidazolinium betaines and sulfobetaines. The surfactants mentioned are all known compounds. Information on the structure and production of these compounds can be found in relevant synoptic works, cf. for example J. Falbe (ed.), "Surfactants in Consumer Products", Springer Verlag, Berlin, 1987, pages 54 to 124 or J. Falbe (ed.), "Katalysatoren, Tenside und Mineralöladditive", Thieme Verlag, Stuttgart, 1978, pages 123 to 217.

Suitable builders are zeolites, layer silicates, phosphates and ethylenediamine tetraacetic acid, nitrilotriacetic acid, citric acid and inorganic phosphonic acids. Suitable thickeners are, for example, hydrogenated castor oil, salts of long-chain fatty acids, which are preferably used in quantities of 0 to 5% by weight and, more preferably, in quantities of 0.5 to 2% by weight, for example sodium, potassium, aluminum, magnesium and titanium stearates or the sodium and/or potassium salts of behenic acid, and other polymeric compounds. The latter preferably include polyvinyl pyrrolidone, urethanes and the salts of polymeric polycarboxylates, for example homopolymeric or copolymeric polyacrylates, polymethacrylates and, in particular, copolymers of acrylic acid with maleic acid, preferably those of 50 to 10% maleic acid. The relative molecular weight of the homopolymers in generally in the range from 1,000 to 100,000 while the relative molecular weight of the copolymers in generally in the range from 1,000 to 100,000 and preferably in the range from 50,000 to 120,000, based on the free acid. Water-soluble polyacrylates which are crosslinked, for example, with about 1% of a polyallyl ether of sucrose and which have a relative molecular weight about 1,000,000 are also particularly suitable. Examples include the polymers obtainable under the name of Carbopol® 940 and 941. The crosslinked polyacrylates are preferably used in quantities of not more than 1% by weight and, more preferably, in quantities of 0.2 to 0.7% by weight.

Suitable enzymes are those from the classes of proteases, lipases, amylases, cellulases and mixtures thereof. Enzymes obtained from bacterial strains or fungi, such as Bacillus, subtilis, Bacillus licheniformis and Streptomyces griseus, are particularly suitable. Proteases of the subtilisin type are preferred, proteases obtained from Bacillus lentus being particularly preferred. They may be used in quantities of about 0.2 to 2% by weight. The enzymes may be adsorbed to supports or encapsulated in shell-forming substances to protect them against premature decomposition. In addition to monofunctional and polyfunctional alcohols and phosphonates, the detergents may contain other enzyme stabilizers. For example, 0.5 to 1% by weight of sodium formate may be used. Proteases which are stabilized with soluble calcium salts and have a calcium content of preferably about 1.2% by weight, base on the enzyme, may also be used. However, it is of particular advantage to use boron compounds, for example boric acid, boron oxide, borax and other alkali metal borates, such as the salts of orthoboric acid ($H_3BO_3$), metaboric acod ($HBO_2$) and pyroboric acid (tetraboric acid $H_2B_4O_7$). Where the detergents are used in machine washing processes, it can be of advantage to add typical foam inhibitors. Suitable foam inhibitors contain, for example, known organopolysiloxanes, paraffins or waxes.

EXAMPLES

In a conventional washing machine (Miele), loads of 3 kg of variously soiled cotton and polyester fabrics were washed with 200 g of a commercial detergent (Wipp Progress, a product of Henkel Ibérica, S.A., Spain) at 30° C. using water with a hardness of 26° dH. Quantities of 2 g of (1) N-methyl morpholinium acetonitrile methosulfate (MMA), (C1) hydrogen peroxide in the form of a 30% by weight solution and (C2) tetraacetyl ethylenediamine (TAED)

were additionally introduced. The lightening of the fabrics (corresponding to soil removal) was photometrically determined. The results are set out in Table 1. Example 1 corresponds to the invention which Examples C1 and C2 are intended for comparison.

TABLE 1

| | Color Lightening | | | | | |
|---|---|---|---|---|---|---|
| | Cotton | | | Polyester | | |
| Color Lightening [% rel.] | 1 | C1 | C2 | 1 | C1 | C2 |
| Soils | | | | | | |
| Tea | 17.1 | 13.5 | 12.1 | 19.3 | 7.0 | 8.0 |
| Red Wine | 14.5 | 6.5 | 6.6 | 23.5 | 9.0 | 10.0 |
| Coffee | 8.2 | 6.2 | 7.1 | 4.8 | 2.5 | 1.0 |
| Red currant | 8.7 | 4.5 | 7.0 | 16.7 | 5.8 | 6.1 |
| Tomato ketchup | 11.6 | 2.3 | 3.3 | 9.3 | 1.8 | 2.2 |
| Lipstick | 5.6 | 5.0 | 5.5 | 2.6 | 2.5 | 2.5 |
| Make-up | 4.6 | −3.5 | −3.6 | 8.6 | 4.9 | 4.8 |
| Collar soil | 2.8 | −4.8 | −5.0 | −1.4 | −0.4 | −1.0 |

It can be seen that the activator MMA has a stronger color-lightening effect, i.e., leads to better soil removal, than hydrogen peroxide or TAED over all soils.

What is claimed is:

1. A method of activating an inorganic peroxygen compound present in a detergent composition comprising contacting the inorganic peroxygen compound with N-methyl morpholinium acetonitrile methosulfate and wherein the detergent composition contains from 70% to 99% by weight of a surfactant, 8% to 25% by weight of the inorganic peroxygen compound, and 0.1% to 10% by weight of N-methyl morpholinium acetonitrile methosulfate.

2. A method according to claim 1 wherein the detergent composition is free of hydrogen peroxide as a source of the inorganic peroxygen compound.

* * * * *